United States Patent [19]

Kuehn

[11] Patent Number: 4,856,938

[45] Date of Patent: Aug. 15, 1989

[54] METHOD OF AND ARRANGEMENT FOR SEPARATING TUBULAR FOUNDATION PILES UNDER WATER

[75] Inventor: Hans Kuehn, Hamburg, Fed. Rep. of Germany

[73] Assignee: Bomag-Menck GmbH, Boppard, Fed. Rep. of Germany

[21] Appl. No.: 133,903

[22] Filed: Dec. 15, 1987

[30] Foreign Application Priority Data

Jul. 28, 1987 [EP] European Pat. Off. ..... 87110888.2

[51] Int. Cl.[4] ..... E02D 9/04

[52] U.S. Cl. ..... 405/227; 166/55; 166/55.7; 405/195; 405/232; 30/92

[58] Field of Search ..... 405/232, 228, 227, 195; 166/55, 55.7, 55.8; 30/92, 103; 83/178, 191

[56] References Cited

U.S. PATENT DOCUMENTS

| | | | |
|---|---|---|---|
| 2,622,679 | 12/1952 | Ransom | 166/55.7 |
| 3,396,795 | 8/1968 | Venghiattis | 166/55.7 |
| 4,339,008 | 7/1982 | Ford et al. | 166/55.7 X |
| 4,768,899 | 9/1988 | Dysarz | 405/227 |

*Primary Examiner*—Dennis L. Taylor
*Attorney, Agent, or Firm*—Michael J. Striker

[57] ABSTRACT

For separating tubular foundation piles under water, a working device with a downwardly extending supporting shaft and at least one separating tool is placed on an upper edge of the pile so that the separating tool is inserted into the supporting shaft, and then the working device is clamped on the pile and the separating tool is rotated about a longitudinal axis of the supporting shaft to penetrate through the wall of the pile.

40 Claims, 6 Drawing Sheets

METHOD OF AND ARRANGEMENT FOR SEPARATING TUBULAR FOUNDATION PILES UNDER WATER

BACKGROUND OF THE INVENTION

The present invention relates to a method of and an arrangement separating tubular foundation piles, under water, in accordance with which a separating tool arranged in inner space of the piles penetrates through its wall.

For a long time it has been known to arrange drilling and production platforms or islands in open sea for exploiting raw materials located under the sea bottom. These islands are fixed as a rule by tubular foundation piles which are rammed into the sea bottom. Such foundation piles are driven either through the inner space of the tubular island legs or through pile holders arranged in the foot region of the drilling island legs. Then they are permanently connected to the anchoring structure by filling of the annular gap between the pile end extending beyond the sea bottom and the surrounding pile holder or island leg with concrete. When the deposits expolited this way are finally depleted, the drilling or production islands required for the exploitation become useless and form disturbing obstacles for the navigation. Several small structures standing in shallow water and anchored with only few foundation piles of small diameter and thin walls have been removed by dismounting the respective foundation piles with explosions activiated very close to the sea bottom. This method is however not applicable for structures which are anchored with many large foundation piles of great wall thickness and at great water depth. In addition, such underwater explosions which can lead to killing of living creatures in large areas are prohibited in many regions because of environmental protection measures.

In another case, after removal of the production platform a hydraulically driven separating tool is centrally placed by a crane onto the remaining structure and guided through the outwardly open drilling island leg to its foot region into the foundation pile which remains in the sea bottom. It is guided over the pile wall and produces a separation cut in the wall. This working procedure requires however the arrangement of a working frame or scaffold on each drilling island, and is generally very time consuming and expensive. It cannot be used for big drilling islands which are based in deep water, since they are anchored with a great number of foundation piles which are grouped around each drilling island leg. These foundation files are guided in pile holders arranged on the island legs, and are permanently connected with the latter after the driving by filling the annular space with concrete.

SUMMARY OF THE INVENTION

Accordingly, it is an object of the present invention to provide a method of and an arrangement for separating tubular foundation piles under water, which insure also in great water depth a simple and reliable separation of foundation piles even at a location lying under the sea bottom and can be applied from a working ship.

In keeping with these objects and with others which will become apparent hereinafter, one feature of the present invention resides, briefly stated, in a method of separation of tubular foundation piles under water in which the wall of the pile is penetrated by a separating tool introduced into the inner space of the pile, which is characterized in that a working device with a downwardly extending supporting shaft is arranged so that the supporting shaft is introduced into the pile and the working device is placed on its upper edge, the working device is fixed relative to the pile from outside and/or from inside, and at least one cutting or burning tool connected with the supporting shaft is rotated on the pile wall about the longitudinal axis of the supporting shaft.

The placing and fixation of the working device on the upper edge of the foundation pile can be performed relatively fast and simply from a working ship, while the cutting or burning tool located at the lower end of the supporting shaft introduced into the inner space of the pile separates the pile at the location lying under the sea bottom so that it no longer forms an obstacle on the sea bottom.

Another feature of the invention is an arrangement for separating tubular foundation piles under water which has a working device to be placed on the upper edge of the pile to be separated and provided with a downwardly extending supporting shaft and at least one cutting or burning tool connected with the supporting shaft, clamping means for fixing the working device relative to the inner wall and/or outer wall of the pile, and means for rotating the cutting or burning tool on the wall of the pile about the longitudinal axis of the supporting shaft.

The inventive arrangement can be lowered on a crane cable of a working ship and placed with centering on the upper edge of the tubular foundation pile to be separated, so that the longitudinally extending downwardly projecting supporting shaft extends centrally into the foundation pile. The clamping means fix the working device against the peripheral wall of the pile, so that simultaneously a centering and a reliable holding against vertical and horizontal movements and also against possible torque acting during separation of the pile wall by the cutting tool are achieved.

The inventive arrangement comprising a the working device lowerable under water may have an electrohydraulic working unit with hydraulic motors for rotating the supporting shaft or the tool holder, and also respective pumps which are driven by electric motors or connected in a close circuit with a pressure medium container or in open circuit with surrounding water. Such arrangement can operate in great water depths without long pressure medium conduits with high efficiency. When the advantageously tubular supporting shaft or the tool holder is provided on the lower end with cutting edges, the sinking matter which is deposited in the foundation pile to be separated can simultaneously be released during insertion of the supporting shaft into the interior of the foundation pile and rinsed away. Thereby even when the pile is completely filled with solid matter, the cutting or burning tool can then be introduced into the pile to the depth which is provided for the desired separating cut.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
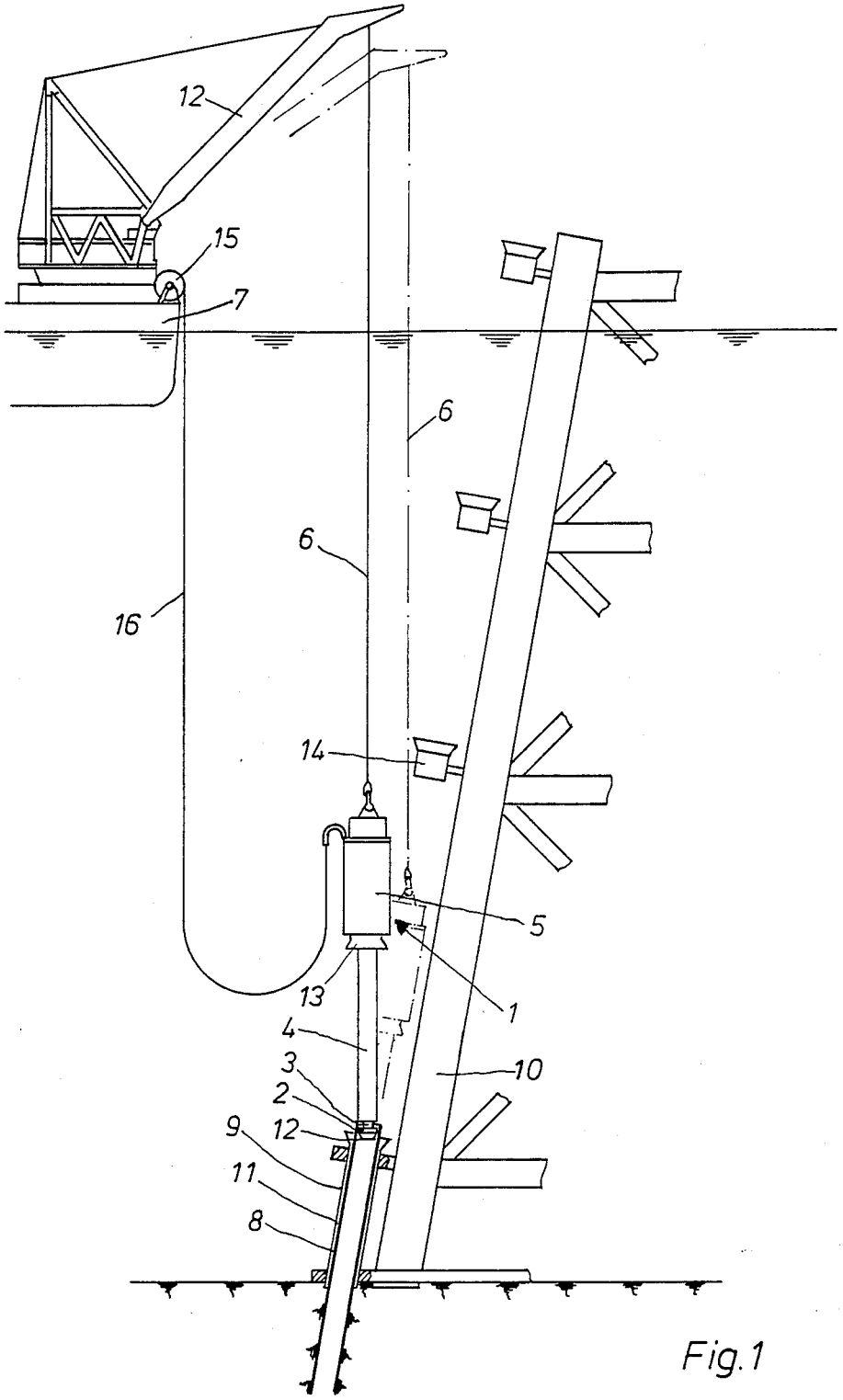
FIG. 1 is a schematic view showing an arrangement in accordance with the present invention which is lowered on a supporting cable onto a pile arranged on a drilling island leg.
Figures 2, 3:
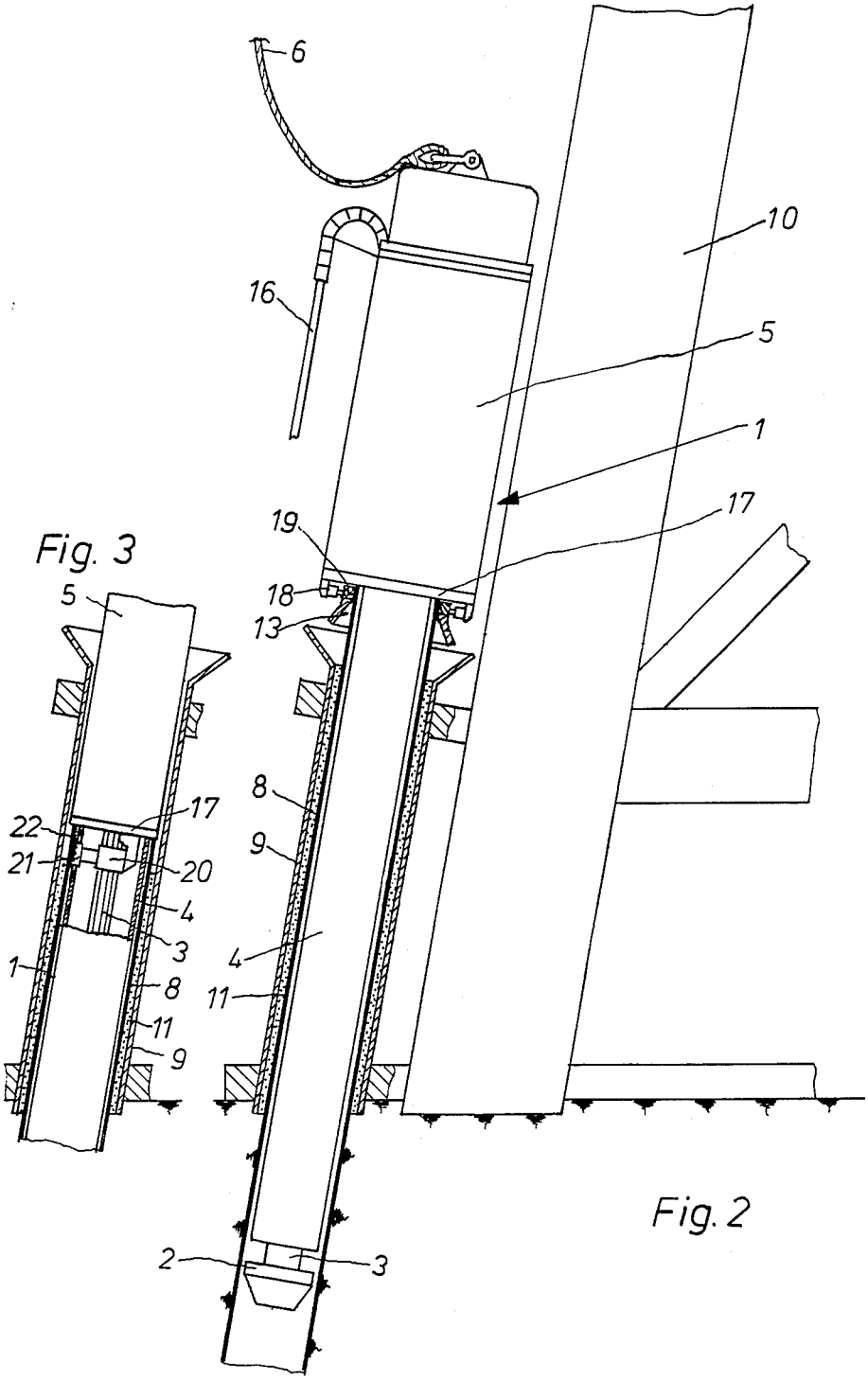
FIG. 2 is an enlarged schematic view of the arrangement of FIG. 1 in the position in which it is placed on the pile.
FIG. 3 is a view showing another slim embodiment of the arrangement which is placed on the upper edge of the pile which is located deep in a pile holder.

The working device 1 shown in FIGS. 1 and 2 is lowered on a crane cable 6 of a crane 12 of working ship 7 onto a pile 8 under water near a drilling island leg 10. The pile 8 is permanently connected with a pile holder which is mounted on the drilling island leg 10, by means of a concrete layer 11 which fills an annular gap between the pile and the pile holder 9.

The working device 1 has an electro-hydraulic drive unit 5 which is supplied with electrical energy via an umbilical cord 16 which is suspended from a winch 15 of the working ship 7. The umbilical cord 16 also includes required signal and control conductors which is known in the art. The working device 1 further has an elongated protective tube 4 which extends downwardly. A supporting shaft 3 concentrically passes through the inner space of the protective tube 4 and has a lower end which extends beyond the protective tube 4 and supports a tool support 2. An inlet cone 13 is arranged around the protective tube 4.

The length of the working device 1 is selected so that after insertion of the conical tool support 2 into the upper opening of the tubular pile 8, it can be tilted by slight lowering of the beam of the crane 12 to the position shown in a broken line in FIG. 1, without colliding with pile guides 14 which are mounted on the drilling island leg. From this position the working device 1 can be lowered then to the position shown in FIG. 2. The inlet cone 13 of the working device 1 is automatically centered on the pile 8 so that a support plate 17 is placed on the upper edge of the pile 8. Pressing cylinder-piston units 18 which act radially in one direction and are arranged on the lower side of the support plate 17, press clamping jaws 19 against the outer peripheral wall of the pile 8, so that the working device is fixedly centered on it and can take up any forces which are produced from the torque of a cutting tool working on the inner wall of the pile 8.

In the embodiment shown in FIG. 3, the working device 1 is narrower so that it can be placed on the upper edge of the pile 8 which lies deep in the pile holder 9. In this embodiment, pressing cylinder-units 20 are provided inside the protective tube 4 around the supporting shaft 3 on the bottom plate 17. They press associated clamping jaws 21 through openings 22 in the protective tube 4 against the inner wall of the pile 8. In this Figure and in the following Figures, pressure medium conduits which are connected with a hydraulic accumulator and conventionally required for actuation of the pressing cylinder/piston unit 20, the return conduits to a pressure medium container, and the associated switching valves are not shown for the sake of clarity of the drawings.

Figure 4:
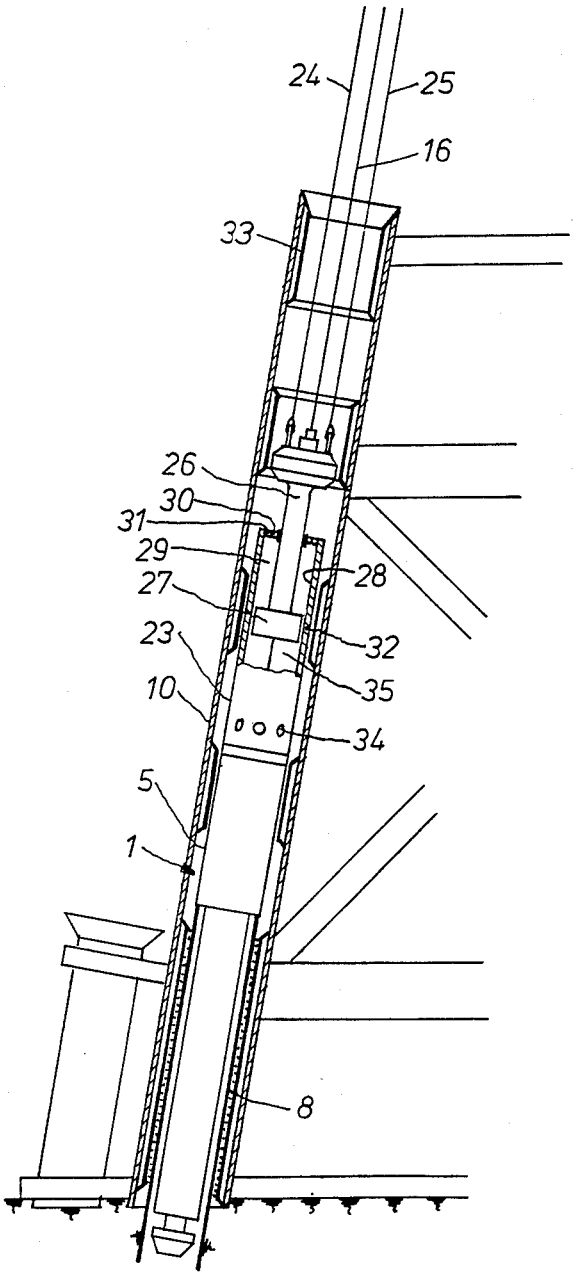
FIG. 4 is a view showing the arrangement of FIG. 3 which is placed through a drilling island leg onto a pile guided in it.

In the embodiment shown in FIG. 4, the working device 1 is placed on the upper edge of the pile 8 which is guided deeply in the drilling island leg 10. It has a compensator 23 which is arranged on the upper side of the drive unit 5 and is suspended on two supporting cables 24 and 25 on crane 12 of the working ship 7. The umbilical cable 16 extends from the winch 15 through a hollow piston rod 26 of the compensator 23 to the drive unit 5. The compensator 23 serves for equalization of the relative movements between the working device 1 which is fixedly rested on the pile 8, and the working ship 7 or the beam of the crane 12 which are movable under the action of sea waves. The compensator 23 includes a cylinder 28 which is subdivided by a piston 27 connected with the piston rod 26 into an upper chamber 9 and a lower chamber 35. The supporting cables 24 and 25 are rigidly held by the weight of the piston 27 and the piston rod 26. Water is accommodated in the chambers 29 and 35. During an upward movement of the piston 27, water is displaced through openings 30 in a cylinder cover 31 from the upper chamber 29, while during a downward movement of the piston 27 it can flow in reverse through the openings 30 into the upper chamber 29. The openings 30 are dimensioned so that they apply a low throughflow resistance to the upward movement which corresponds to the relatively slow sea motion. When to the contrary the working device 1 during insertion into the drilling island leg 10 is placed by error on an edge or in another words canted so that during further relief of the supporting cables 24 and 25 it is first retained and suddenly falls in a free fall, the openings 30 together with an annular gap 32 between the piston 27 and the wall of the cylinder 28 act for strong braking and reduce the speed of fall of the working device 1. As a result of this, the remaining movement energy is taken up by cushioning of the mass with the supporting cables 24 and 25 and the working device overcomes the shock without damages.

The lower chamber 29 of the cylinder 28 has openings 34 through which the water flows in and flows out. The openings 34 must be greater than the openings 30 since during the upward movement of the piston 27 the weight of the whole working device acts via the water cushion in the chamber 29 onto the piston 27, while during downward movement only the weight of the piston 27 and the piston rod 26 is applied. This downward movement must not be reduced by flow-related delays, so that the supporting cables 24 and 25 are always retained tensioned and cannot get entangled.

Since the compensator 23 is directly connected with the drive unit 5, the working device 1 has a great length which is advantageous for its guidance since it is always guided in at least two guides 10*a* of the drilling island leg 10. The supporting cables 24 and 25 are shown in FIG. 4 as turned by 90°, to show that they extend near the umbilical cable 16.

Figure 5:
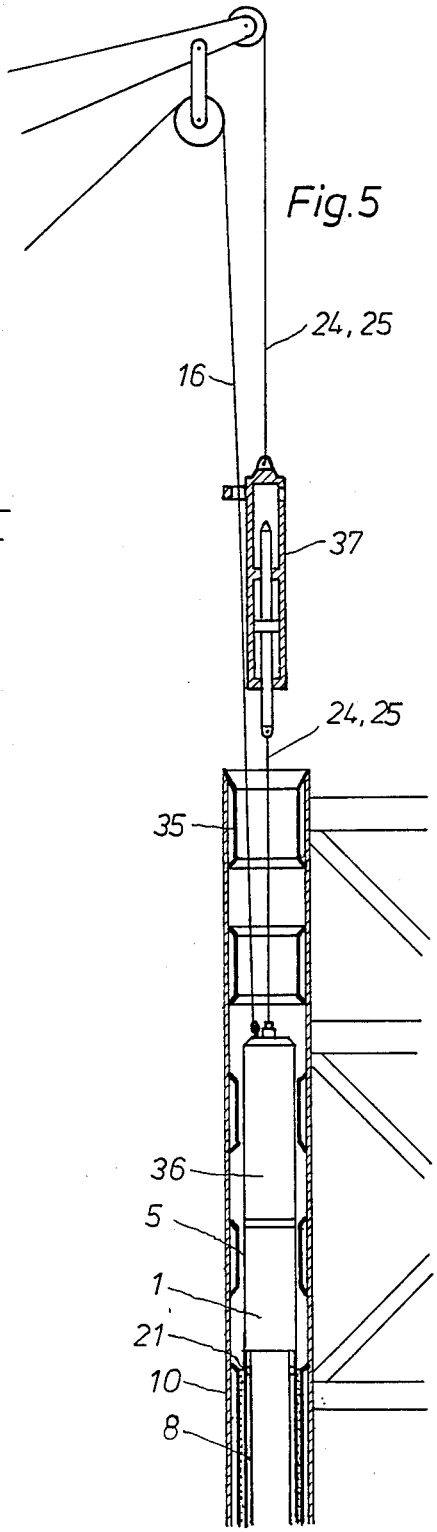
FIG. 5 is a view of the arrangement of FIG. 4 placed on a foundation pile in a vertical drilling island leg.

In the embodiment shown in FIG. 5, the working device 1 is placed in a vertical drilling island leg 10 on the pile 8 and carries on its upper side an extension pipe 36 for obtaining the desired guiding length. A hydropneumatic compensator 37 is arranged in the supporting cables 24 and 25. It is explained in detail in the German Patent Application No. P 3,546,277.9 of the same inventor. The operation of the compensator 37 can be optically monitored by underwater cameras. Also the braking action can be adjusted better by adaptation of the gas-pretensioning pressure to each particular weight of the working device 1. These advantages however can be obtained only, if during extension of the compensator by a swelling wave movement a pulling force which acts on the working device 1 through the high gas pretensioning can be taken by the friction of the clamping jaws 21. For this purpose it suffices only to increase the pressure of the pressure medium supplied by the pressing cylinder-piston units 20.

Figure 6:
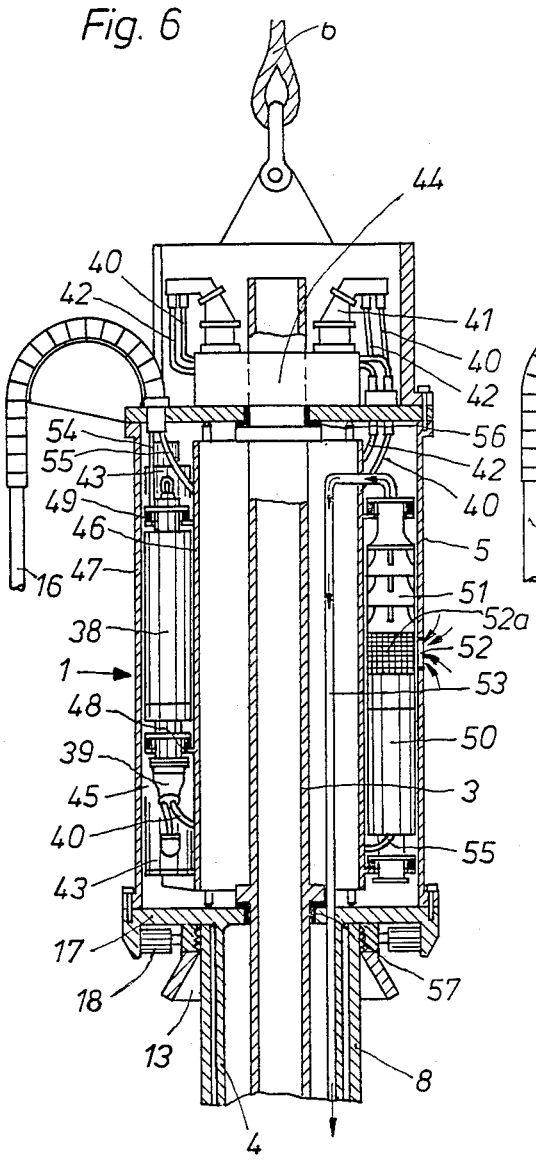
FIG. 6 is a longitudinal section of an arrangement of the present invention provided with an underwater drive unit.

The working device shown in FIG. 6 has a drive unit 5 with closed pressure medium circuit. The pressure medium circuit includes a row of pump units each provided with a hydraulic pump 39 which is flanged on an electric motor 38 and connected respectively via a connecting conduit 40 with a hydraulic motor 41 and via a connecting conduit 42 with a pressure medium container 43. The supporting shaft 3 which is driven from the hydraulic motors 41 via a transmission 44 is supported in the drive unit 5, on the one hand, in a bearing 57 of the supporting plate 17 and, on the other hand, in a bearing 56 of the cover plate. The drive unit 5 includes an outer wall 47 which connects the supporting plate 17 with the cover plate, and a concentric inner wall 46 which is elastically spring-biased against the supporting plate 17 and the cover plate respectively by pre-tensioned spring devices. The pump units are distributed respectively over the inner wall 46 and arranged between the inner wall and the outer wall 47 via supporting projections 48 and elastic supporting elements 49. A water pump 51 connected with an electric motor 50 is arranged in the annular chamber 45. It aspirates surrounding water via a suction opening 52 and a filter sieve 52*a* and supplies this water with pressure increase via a connecting conduit 53 for the purpose which will be explained herein below. The electric motors 38 and 50 are supplied with electrical energy via electrical conductors 54 and 55 located in the umbilical cable 16 from the working ship 7.

Figure 7:
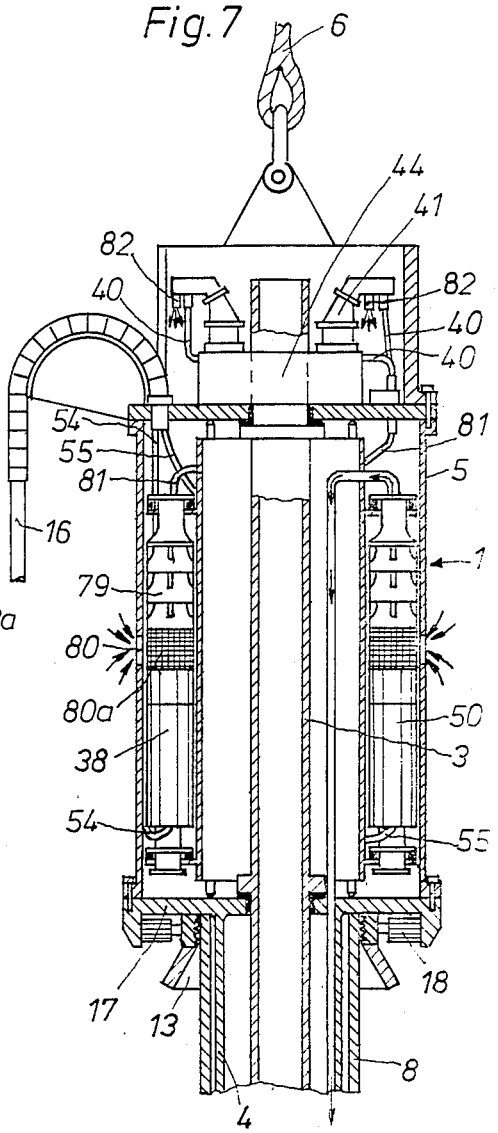
FIG. 7 is a longitudinal section of a similar arrangement with an open pressure medium circuit.

In the different embodiment shown in FIG. 7, all electric motors 38 and 50 are respectively connected with a flanged pressure water pump 79. The pressure water pump aspirates surrounding water via an aspiration opening 80 and a filter sieve 80*a* and supplies the pressure water via connecting conduits 81 and 40 to the hydraulic motors 41 for driving the supporting shaft 3 via the transmission 44. The pressure water is freely discharged outside after this from outlet pipes 82 so that it forms a pressure medium circuit which is open to the surrounding area. Here also the electric motors 38 and 50 are supplied with electrical energy via electrical conductors 54 and 55 which are guided through the umbilical cable 16.

Figure 8:
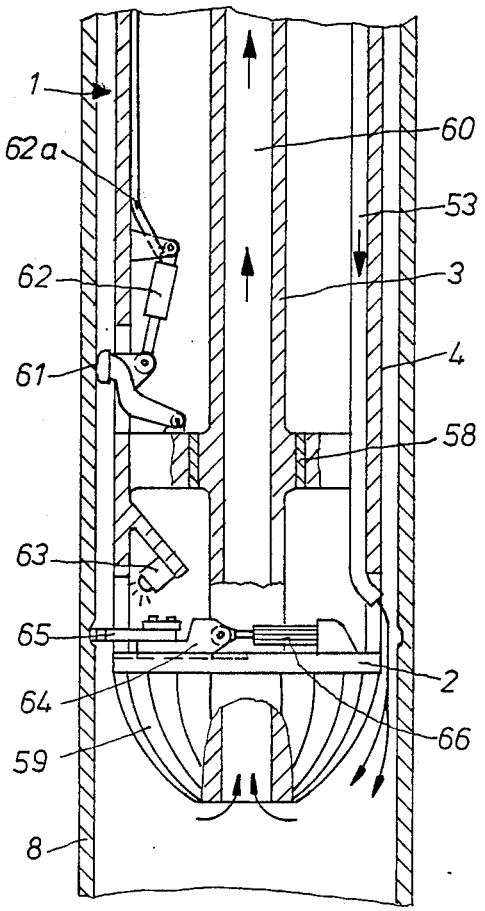
FIG. 8 is a view showing an enlarged longitudinal section of the lower end of the supporting shaft of the arrangement of FIG. 2.

In the embodiment shown in FIG. 8, the supporting shaft 3 is additionally centrally supported in a bearing 58 which is arranged in the protective tube 4 near its lower end. At its free end it is connected with an exchangeably mounted tool support which conically reduces in a downward direction and is provided with cutting edges 59. The clamping jaws 61 are tunably supported in lateral openings of the protective tube 4 and can be pressed by the associated hydraulic cylinder-piston unit 62 against the inner wall of the pile 8.

In the event if the inner space of the pile 8 is filled over a certain time with deposited and rigidified sinking matter which prevents further insertion of the supporting shaft 3, the tool holder 2 is driven during the insertion of the protective pipe 4 into the pile 8 via the supporting shaft 3 similarly to a drill and therefore releases the deposited sinking matter by its cutting edges 59. Simultaneously pressure water can be supplied via a connecting conduit 53 from the water pump 51 to the tool holder 2 for softening the sinking matter and rinsing it after the release via a through going passage 60 of the tubular supporting shaft 3 upwardly out of the pile 8. The propulsion force required for the penetration is provided by the own weight of the working device. Since during peeling off the sinking matter layers no high torques ar required the clamping jaws 61 for preventing a rotation of the working device 1 and the umbilical cable 6 and the supporting cables 6 or 24 or 25 are only slightly pressed against the inner wall of the pile, so that they take up the low torque by friction, and on the other hand, the working device 1 can then still automatically under the action of its own weight in correspondence with the penetration progress. In the event if a firmer friction is required, the clamping jaws 61 can naturally be released for a short time with the supporting shaft 3 stopped, and after subsequent sinking of the working device 1 against pressed against the inner wall of the pile 8.

As long as the working device 1 is firmly seated on the upper edge of the pile 8 and fixed in a central position on the pile by the clamping jaws 21 which are actuated by the pressing cylinder-piston units 20, it is also firmly centrally supported on the inner wall of the pile 8 in the lower region of the elongated protective tube 4 which extends into the pile 8, by the clamping jaws 61, so that the supporting shaft 3 with the tool holder 2 cannot be driven into lateral oscilations under the action of vibrations. When for example the supporting shaft 3 with a length of 20 meter is inserted into the pile 8 and there is no lateral support in the lower region of the protective pipe, such oscillations can affect the separation of the pile wall or make it completely impossible. The pressure medium conduits 62*a* which are required for supplying the hydraulic cylinder 62 are arranged on the inner wall of the protective tube 4 for the drive unit 5.

A tool carriage 64 is displaceably guided in a horizontal guide on the tool holder 2. A cutting tool 65 which is formed as a cutting steel piece and schematically shown in FIG. 8 is arranged on the tool carrige 64. During rotation of the supporting shaft 3 and the tool holder 2, it produces a desired separation cut in the wall of the pile 8. The cutting tool 65 can be steplessly adjusted by displacement of the tool carriage 64 by means of a hydraulic adjusting cylinder-piston unit 66, so as to adjust the depth of cut in correspondence with the working process. Several underwater cameras 63 are arranged on the lower edge of the protective tube 4 inwardly thereof and distributed over its periphery, for monitoring the separating cut over the entire periphery. Instead of this, an underwater camera can be provided on the supporting shaft 3 or the tool holder 2 and rotate with them. The supply conduits for the underwater cameras which are not shown in FIG. 8 for clarity, can run on the inner wall of the protective tube 4 or over the supporting shaft 3 and a conventional sliding ring-rotary connection to the drive unit 5.

Figure 9:
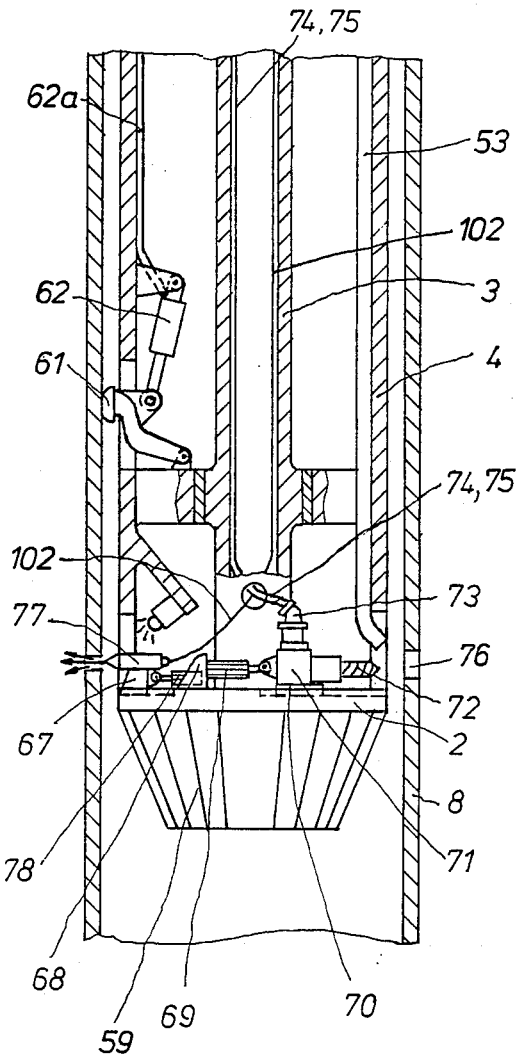
FIG. 9 is an enlarged longitudinal section of the lower portion of the supporting shaft of an arrangement in accordance with a different embodiment.

In the different embodiment shown in FIG. 9, a tool carriage 67 which is displaceable in a horizontal guide by means of hydraulic adjusting cylinder-piston unit 78 is arranged on the tool holder 2 provided with conical cutting edges 59. The tool carrige 67 supports an underwater gas flame cutting burner 77. The adjusting cylinder-piston unit 78 is mounted on a supporting block 68, on which a further adjusting cylinder-piston unit 69 is arranged for a further tool carriage 70. The tool carriage 70 carries a drilling device 71 with a drilling tool 72 which is driven by a hydraulic motor 73. The drilling device 71 which is driven through the pressure medium conduits 74 and 75 extending through the throughgoing passage 60 of the supporting shaft 3, serves for producing a hole 76 in the wall of the pile 8 to facilitate the start of the cutting flame for the separating cut. The cutting burner 77 is supplied with burning gas via a supply conduit 102 from a not shown gas container provided on the drive unit 5.

Instead of the cutting and burning tools shown in FIGS. 8 and 9, also other separating tools can be used in accordance with the specific requirements in individual cases. For example, liquid pressure jet cutting can be used with supplying high pressure water jets which optionally carry abrasive particles, or electrical melting burners can be used for these purposes.

Figure 10:
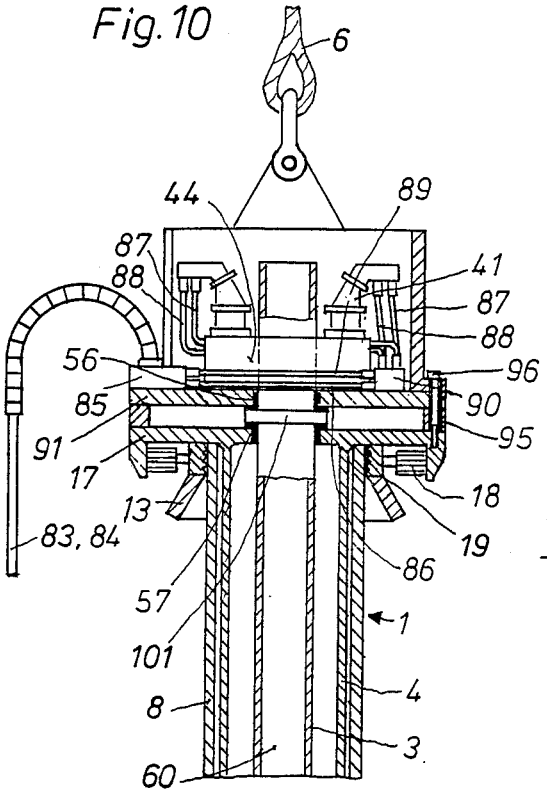
FIG. 10 is a longitudinal section of an arrangement of the invention with a pressure medium supply from a remote pressure medium source.

In the different embodiment shown in FIG. 10, without the built-in electro-hydraulic drive unit, the pressure medium is supplied from a power station above water via a supply conduit 83, a distributor 85 and connecting conduits 86 and 87 to the hydraulic motors 41, and then flows back via connecting conduits 88 and 89, the distributor 85 and a supply conduit 84 to a pressure container above water. The connecting conduits 87 and 88 can be blocked by a valve device 90 when needed for stopping the drive. The supporting plate 17 which is provided on its lower side with the pressing cylinder-piston units 18 and with clamping jaws 19 formed as segments of the inlet cone 13, is fixably connected with a supporting plate 91 via a spacer ring 95 by screws 96 and carries at its lower side also the protective tube 4. The bearings 55 or 57 arranged in the supporting plate 91 or the supporting plate 17 prevent, in cooperation with an annular collar 101 of the supporting shaft 3, vertical displacements of the same. This embodiment which is effectively used in medium water depths, leads to a lighter and shorter design of the working device 1, which facilitates its handling.

Figure 11:
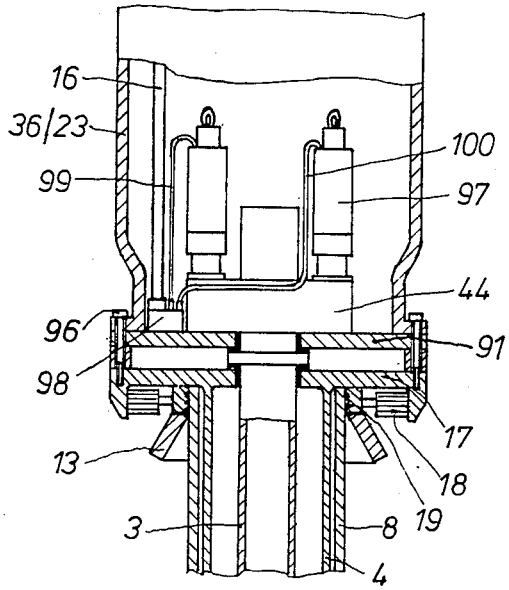
FIG. 11 is a partial longitudinal section of an arrangement in accordance with a different embodiment of the invention.

In the embodiment shown in FIG. 11 the schematically shown transmission 44 is driven directly by electric motors 97. For increasing the guiding length, an extension pipe 36 or a compensator 23 of FIG. 4 is provided for surrounding the electric motors 97. The outer diameter of these elements can correspond to the respective requirements. The electric motors 97 are driven via the umbilical cable 16, a distributor 98 and connecting conduits 99 and 100.

Figure 12:
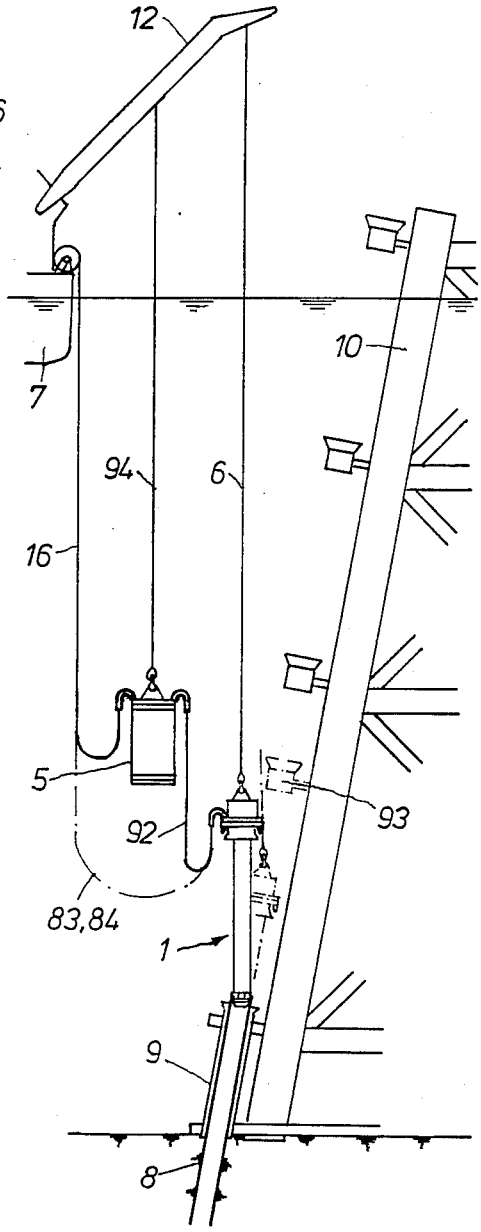
FIG. 12 is a schematic view of an arrangement placed on a ramming pile in accordance with FIG. 10, with adjacent suspended driving unit.

In the arrangement shown in FIG. 12 the working device 1 of FIG. 10 suspended on the supporting cable 6 of the crane 12 of a working ship 7 is lowered with a conical tool holder 2 into the opening of the pile 8 which is guided in a pile holder 9 at the foot of a drilling island leg 10. An electrolydraulic underwater drive unit 5 of the type shown in FIG. 6 is suspended near the working device 1 on a further supporting cable 94 of the crane 12. Its hydraulic pumps 39 are connected via connecting conduits 92 with the distributor of the working device 1. The drive unit 5 is supplied with electrical energy via the umbilical cable 16 from the working ship 7. In this way on the other hand operational losses which take place in long pressure medium hoses 93 and 94 extending over water, because of considerable flow resistance and viscosity increase, by cooling of the pressure medium in sea water are eliminated. On the other hand, insertion of the working device in the pile 8 is made possible by the short design of the working device 1 also with a relatively small distance of the pile guide 93 over the pile holer 9. This operational mode is advantageous in many cases, despite the required separate lowering of the drive unit 5.

The above described preferred embodiments of arrangements and methods can be modified by an expert in the field in accordance with respective requirements in individual cases in different ways, as long as the working device is firmly placed with insertion of the supporting shaft 3 into the pile 8 on its upper edge, and the separation of the pile wall is performed by rotation of a separating tool connected with the supporting shaft 3.

It will be understood that each of the elements described above, or two or more together, may also find a useful application in other types of constructions differing from the types described above.

While the invention has been illustrted and described as embodied in an arrangement for separating tubular foundation piles under water, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for separating tubular foundation piles with upper edges under water, comprising a working device provided with downwardly extending supporting shaft, a tool holder provided with a conical shape at its lower end, and at least one separating tool carried by said tool holder and connected with said supporting shaft, said working device having a supporting surface arranged to be placed on an upper edge of a pile to be separated so that said separating tool extends into an inner space of the pile, said supporting shaft being connected with said supporting surface; means for fixing said working device relative to a pile wall; and means for rotating said separating tool on the pile wall about a longitudinal axis of said supporting shaft so that said separating tool penetrates through the pile wall.

2. An arrangement as defined in claim 1, wherein said separating tool is directly arranged on said supporting shaft, said rotating means being arranged to rotate said supporting shaft and therefore said separating tool.

3. An arrangement as defined in claim 1, wherein said rotating means is arranged to rotate said tool holder and thereby said separating tool.

4. An arrangement as defined in claim 3, wherein said tool holder is rotatably supported on said supporting shaft.

5. An arrangement as defined in claim 1, wherein said supporting shaft is rotatable concentrically relative to said supporting surface of said working device.

6. An arrangement as defined in claim 1, wherein said rotating means includes hydraulic drive means with at least one pump and at least one hydraulic motor driven by said pump and arranged to rotate said separating tool.

7. An arrangement as defined in claim 6, wherein said pump is formed so that it is located above water; and further comprising a pressure medium container arranged above water, and supply conduits connecting said hydraulic motor with said pump and said pressure medium container.

8. An arrangement as defined in claim 6, wherein said pump is arranged in said working device; and further comprising a pressure medium container connected with said pump.

9. An arrangement as defined in claim 6, wherein said pump is arranged in said working device and operative for aspirating surrounding water, increasing its pressure and supplying it with increased pressure to said hydraulic motor.

10. An arrangement as defined in claim 5, wherein said supporting surface is arranged to abut in operating position against the upper edge of the pile abuts and further comprising an inlet cone which is arranged around said supporting shaft and outwardly surrounds the upper edge of the pile abutting against said supporting surface.

11. An arrangement as defined in claim 1; and further comprising a protective tube surrounding said supporting shaft with a distance therebetween and being insertable into the pile with a sufficient play relative to the latter.

12. An arrangement as defined in claim 1, and further comprising means for removing a sinking matter deposited in an inner space of the pipe.

13. An arrangement as defined in claim 12, wherein said removing means including cutting means provided on said supporting shaft.

14. An arrangement as defined in claim 12, wherein said removing means is formed as cutting means provided on said tool holder.

15. An arrangement as defined in claim 12, wherein said removing means includes a water pump and a rinsing conduit extending from said water pump and arranged to rinse the sinking matters through said supporting shaft so as to release the sinking matter.

16. An arrangement as defined in claim 1, wherein said fixing means include clamping jaws and pressing cylinder-piston units arranged to act radially inwardly upon said clamping jaws so as to clamp latter against an outer surface of the pile.

17. An arrangement as defined in claim 16, wherein said working device has a supporting plate arranged to be placed onto the pile and having a lower side, said pressing cylinder-piston unit being arranged on said lower side of said supporting plate.

18. An arrangement as defined in claim 11, wherein said protective tube has a lower end; and further comprising a bearing arranged near said lower end of said protective tube, said supporting shaft being rotatably supported in said bearing.

19. An arrangement as defined in claim 11, wherein said fixing means includes at least one clamping jaw provided on said supporting tube and a pressing cylinder-piston unit acting upon said clamping jaw so as to press it against an inner wall of the pile.

20. An arrangement as defined in claim 1, wherein said separatng tool is radially extendable and retractable; and further comprising means for radially extending and retracting said separating tool.

21. An arrangement as defined in claim 20, wherein said means for radially extending and retracted includes an adjusting cylinder-piston unit cooperating with said separating tool.

22. An arrangement as defined in claim 20 and further comprising supply conduits arranged to supply power for extending and retracting said separating tool.

23. An arrangement as defined in claim 22, wherein said means for extending and retracting is formed as pressure medium operated means, said supplying conduits being arranged to supply pressure medium to said pressure medium operated means.

24. An arrangement as defined in claim 22, wherein said means for extending and retracting is formed as gas operated means, said pressure supply conduit being arranged ot supply gas to said gas operated means for extending and retracting said separating tool.

25. An arrangement as defined in claim 22, wherein said extending and retracting means is formed as electrically operating means, said supplying conduits being formed to supply electrical energy to said electrical operating means for extending and retracting said separating tool.

26. An arrangement as defined in claim 1, wherein said rotating means includes at least one hydraulic motor arranged to drive said tool holder.

27. An arrangement as defined in claim 1, wherein said supporting shaft is fixedly connected with said working device and has a lower end provided with a coaxially rotatably supported tool holder, said rotating means including at least one hydraulic motor which is arranged on said supporting shaft and supply conduits extending through said supporting shaft and connected with said hydraulic motor and said tool holder to drive the latter.

28. An arrangement as defined in claim 1, wherein said rotating means includes at least one hydraulic motor and at least one transmission connecting said hydraulic motor with said supporting shaft for rotating the latter.

29. An arrangement as defined in claim 1, wherein said rotating means includes at least one electric motor and at least one transmission connecting said electric motor with said supporting shaft for rotating the latter.

30. An arrangement as defined in claim 11, wherein said supporting shaft and said protective tube have two elements, at least one of said elements being longitudinally adjustable.

31. An arrangement as defined in claim 30, wherein said supporting shaft and said protective pipe are both longitudinally adjustable.

32. An arrangement as defined in claim 30, wherein said one element is formed telescopably and is telescopably and longitudinally adjustable.

33. An arrangement as defined in claim 30, wherein said one element is provided with a releasably connectable extension segment so as to longitudinally adjust said one element.

34. An arrangement for separating tubular foundation piles under water, comprising a working device provided with downwardly extending supporting shaft and at least one separating tool connected with said supporting shaft, said working device being placeable on an upper edge of a pile to be separated so that said separating tool extends into an inner space of the pile; means for fixing said working device relative to a pile wall; and means for rotating said separating tool on the pile wall about a longitudinal axis of said supporting shaft so that said separating tool penetrates through the pile wall, said working device including a working unit provided with supporting plate to be placed on the pile, with an outer wall, and an iner wall which surrounds a central receiving space, and rotating means including a plurality of pump units arranged in a space between said outer wall and said inner wall and distributed in the circumferential direction and each provided with a pump, an electric motor connected with each of said pumps, and a pressure medium container associated with each of said pumps.

35. An arrangement as defined in claim 34, wherein said pumps of said pump units are hydraulic pumps.

36. An arrangement as defined in claim 34, wherein said pumps of said pump unit are water pumps.

37. An arrangement as defined in claim 34 and further comprising a bearing provided on said supporting plate, and a ring-shaped cover plate connected with said outer wall, said supporting shaft extending through said receiving base and being rotatably supported in said bearing and in said cover plate.

38. An arrangement as defined in claim 34, wherein said electric motors and said pumps are supported in said drive unit with spring-biasing vertically in two opposite directions.

39. An arrangement as defined in claim 38, wherein said pressure medium container is also supported in said drive unit spring-biased vertically in opposite directions.

40. An arrangement for separating tubular foundation piles under water, comprising a working device provided with downwardly extending supporting shaft and at least one separating tool connected with said supporting shaft, said working device being placeable on an upper edge of a pile to be separated so that said separating tool extends into an inner space of the pile; means for fixing said working device relative to a pile wall; means for rotating said separating tool on the pile wall about a longitudinal axis of said supporting shaft so that said separating tool penetrates through the pile wall, said working device having an upper side; and a compensator arranged in said upper side of said working device and having a cylinder, a piston subdividing said cylinder into two chambers filled with water, a piston rod connectable with a cable for supporting said working device, said cylinder having a cylinder wall extending over said chambers and provided with a plurality of throughgoing openings for flowing of water into said chambers and out of said chambers.

* * * * *